United States Patent [19]

Barkan

[11] 4,180,788

[45] Dec. 25, 1979

[54] VACUUM CIRCUIT BREAKER WITH DELAYED TRIP OPERATION

[75] Inventor: Philip Barkan, Stanford, Calif.

[73] Assignee: General Electric Company, Philadelphia, Pa.

[21] Appl. No.: 921,938

[22] Filed: Jul. 3, 1978

[51] Int. Cl.[2] ..... H01H 3/42

[52] U.S. Cl. ..... 335/190; 335/73; 335/195

[58] Field of Search ..... 335/190, 195, 170, 174, 335/175, 73, 16, 74, 189

[56] References Cited

U.S. PATENT DOCUMENTS

| | | | |
|---|---|---|---|
| 3,113,191 | 12/1963 | Frank | 335/73 |
| 3,845,263 | 10/1974 | Dickinson | 335/190 |
| 4,032,870 | 6/1977 | Oppel et al. | 335/195 |

*Primary Examiner*—Harold Broome

*Attorney, Agent, or Firm*—William Freedman; Carl L. Silverman

[57] ABSTRACT

An electric circuit breaker includes means for providing a predetermined delay between the initiation of a command pulse and the mechanical operation of an element of the circuit breaker in response to the command pulse. In one embodiment, the predetermined delay is provided between a tripping command pulse and the mechanical operation of the trip mechanism of a vacuum circuit breaker. In this embodiment, a translatable armature is coupled to the trip mechanism through mechanical linkage including a flywheel rotatably mounted on a shaft. The shaft is mechanically coupled to the trip mechanism wherein rotation of the shaft operates the trip mechanism. The translatable armature is mechanically coupled to the flywheel so that movement thereof causes the flywheel to rotate through a predetermined rotation. The flywheel includes impact imposing means extending outwardly from a major face thereof. The shaft includes impact receiving means extending radially therefrom. In operation of this embodiment, following the tripping command pulse, the flywheel rotates through the predetermined rotation with a resulting predetermined delay. At the completion of this rotation, the impact imposing means of the flywheel forcefully engages the impact receiving means of the shaft. This causes the shaft to operate the trip mechanism, causing the circuit breaker contacts to open. Means are provided for varying the predetermined delay. Other embodiments are disclosed.

21 Claims, 9 Drawing Figures

VACUUM CIRCUIT BREAKER WITH DELAYED TRIP OPERATION

BACKGROUND OF THE INVENTION

This invention relates to an electric circuit breaker, and more particularly to a vacuum circuit breaker having means for mechanically imposing a predetermined delay in the tripping operation thereof.

Vacuum circuit breakers are well known devices. Such vacuum circuit breakers generally include one or more vacuum interrupter modules. The maximum fault current interruption rating of such vacuum circuit breakers is related to the peak amplitude of the arcing fault current. In general, the amplitude of the offset, i.e., non-symmetrical, fault current is related to the time interval between the initiation of the fault and the parting of the circuit breaker contacts. That is, the longer the time interval, the lower the arcing fault current, and hence, the easier the interruption.

Inherently, the vacuum interrupter lends itself to fast interruption compared to air-magnetic and oil interruption devices. Hence, when a vacuum interrupter is used in conjunction with conventional circuit breaker operating mechanisms operating with conventional trip devices, it has been found that the tripping performance corresonds to about a three cycle time interruption rating. It is to be appreciated that the opening time rating of a circuit breaker is defined by ANSI rating standards in terms of a specified time from trip command to the parting of the circuit breaker contacts. For example, see ANSI C37.03, pages 9, 10, 1969. Such time ratings are generally stated in terms of a number of cycles at 60 Hertz. For those applications for which a five cycle interruption time rating is adequate, significant benefits can be derived from delaying the unnecessarilyearly parting of the circuit breaker contacts. For example, by delaying the parting of the contacts so as to meet the ANSI standard for a five cycle rating, a given circuit breaker will provide increased fault current interrupting capacity. Also, as compared to an unnecessarily rapid interruption, a delayed interruption may allow the user to employ a less costly vacuum interrupter to achieve the specified fault current rating.

Notwithstanding the advantages of delayed interruption, there are still applications in which more rapid fault interruption, e.g., three cycles, is required. Thus, it would be desirable to provide vacuum circuit breaker tripping means simply adaptable to meet standards for either three cycle or five cycle interruption ratings. It is particularly desirable to provide such adaptability through modifications of only the tripping mechanism, the rest of the circuit breaker assembly remaining unchanged.

In order to provide such delayed tripping means, several requirements must be satisfied. One such requirement is that the delayed tripping means must provide a relatively long tripping time which is not adversely affected by the wide range of circuit breaker operating conditions. For example, the delayed tripping means must operate at one of several nominal voltages, e.g., 48, 125, or 250 V dc with a specified trip time. It is necessary that, at each nominal voltage, the tripping performance must be essentially identical even though the design change is limited solely to changes in the tripping solenoid coil appropriate for the particular voltage. In all other respects, the trip device must remain unchanged. Further, at each of these nominal voltages, the trip time variations must not be excessive as the voltage varies between 75% and 125% of the nominal value. Similarly, the minimum and maximum allowable current which a circuit breaker trip coil can draw are usually restricted by other system considerations. In addition, the delayed tripping means must operate consistently with minimal variation in trip time within an ambient temperature range between about −30° F. and about 140° F. Also, the delayed tripping means, in addition to being simple and reliable, should be compact and insensitive to orientation. For example, for some special applications, it may be necessary to provide two redundant delayed tripping means for each vacuum interrupter in a limited space. In such applications, it is often only possible to install such redundant delayed tripping means in the availble limited space by orienting the two tripping means at different angles with respect to a horizontal plane. Thus, gravitational effects are different in the two delayed tripping means. In addition, it is desirable that the delayed tripping means be simply adaptable to allow the tripping time to be selectably chosen, e.g., to provide either three cycle or five cycle interrupting time rating.

The above-described requirements are not all satisfied by available techniques in which the delay is achieved through such means as high inductance coils, fluid dashpots, and multiple latch devices.

Accordingly, it is a general object of this invention to provide a vacuum circuit breaker with delayed tripping means.

It is another object of this invention to provide such delayed tripping means which is substantially unaffected by circuit breaker operating conditions.

It is another object of this invention to provide such delayed tripping means which is simply adaptable to allow the tripping time to be selectably chosen.

It is another object of this invention to provide such delayed tripping means having a five cycle interrupting time rating.

It is another object of this invention to provide such delayed tripping means in a redundant configuration.

SUMMARY

In carrying out one form of the present invention, I provide an electric circuit breaker with means for providing a predetermined delay between the initiation of a command pulse and the mechanical operation of an element of the circuit breaker in response to the command pulse. The means includes axial shaft means which is mechanically coupled to the element of the circuit breaker which is to be operated wherein a preselected rotation of the shaft means causes the mechanical operation of the element. The axial shaft means includes impact receiving means extending radially therefrom. Flywheel means are rotatably mounted about the axial shaft means with the flywheel means including impact imposing means. The impact imposing means extends generally axially outward from a major face of the flywheel means. An electric solenoid having a translatable armature is provided for rotating the flywheel means. The electric solenoid receives the command pulse. Coupling means mechanically couples the translatable armature to an eccentrically located point on a major face of the flywheel means wherein translation of the armature causes the flywheel means to rotate through a predetermined delay from a first position not operating the element of the circuit breaker to a second position operating the element. At the second position, the impact imposing means of the flywheel means engages the impact receiving means of the shaft means and causes the preselected rotation of this shaft means and the operation of the element.

BRIEF DESCRIPTION OF THE DRAWINGS

For a better understanding of the invention, reference may be had to the following drawings, wherein:

In FIG. 4A, the circuit breaker has not been tripped while in FIG. 4B, the circuit breaker has been tripped.

DETAILED DESCRIPTION OF THE INVENTION

Figure 1:
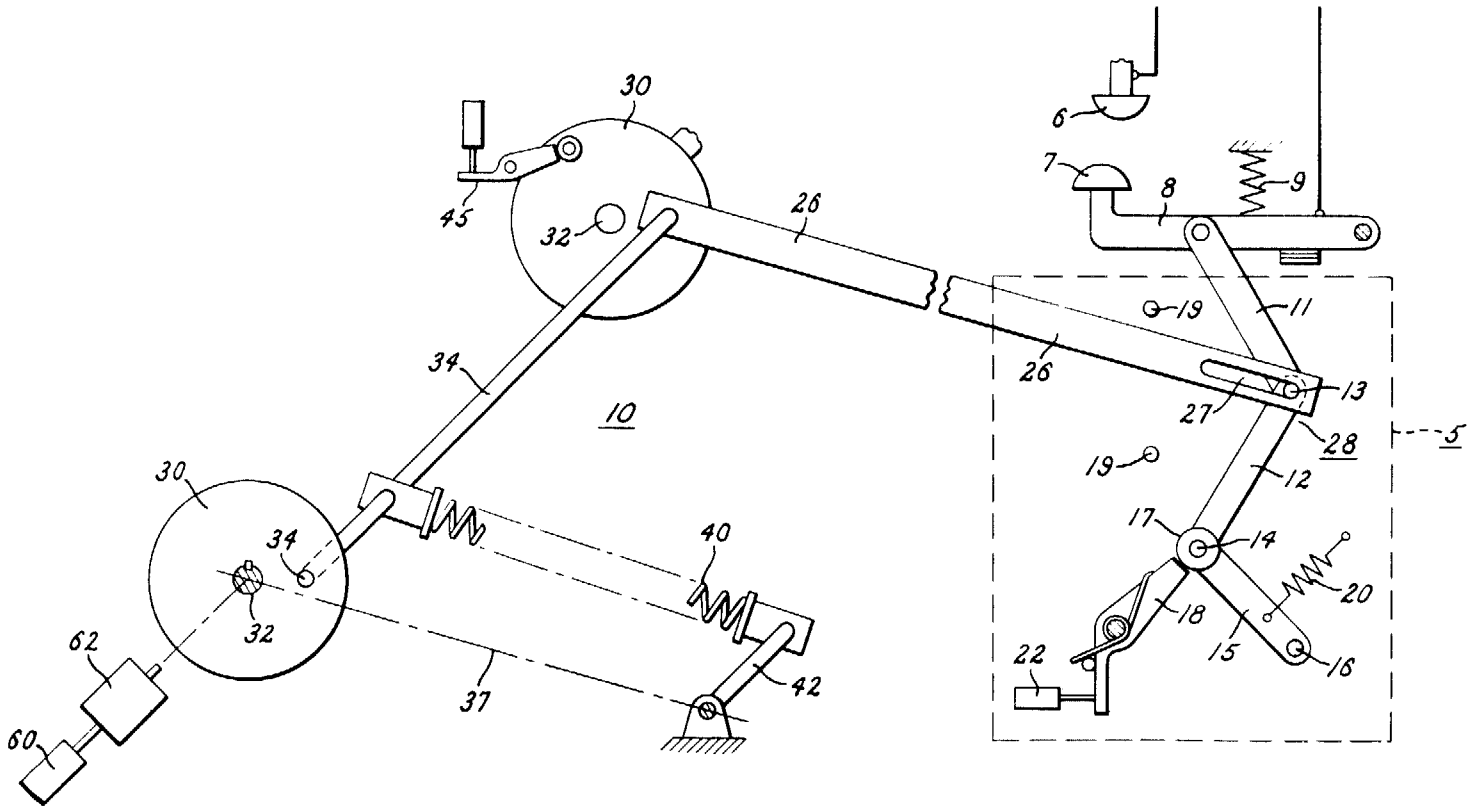
FIG. 1 is a schematic view of one form of vacuum circuit breaker and stored-energy closing device to which the delayed tripping means of the present invention relates. The circuit breaker is shown in an open position.

Referring initially to FIG. 1, a conventional vacuum circuit breaker system is shown. For purposes of clarity, an exemplary preferred circuit breaker system to which the delayed tripping means of the present invention relates will be generally described prior to describing the delayed tripping means.

A vacuum circuit breaker includes a pair of relatively movable contacts 6 and 7. Contact 6 is a stationary contact. Contact 7 is a movable contact carried by a pivotally mounted contact arm 8 biased to the open position shown in FIG. 1 by opening spring 9. Closing forces are transmitted to the movable contact arm 8 by a circuit breaker operating mechanism 5. (Although not shown, contacts 6, 7 are enclosed in a vacuum).

A stored-energy device 10 provides the closing force to the circuit breaker operating mechanism 5. In a preferred circuit breaker system, the stored-energy device includes a pair of flywheels 30, hereinafter often referred to in singular. The flywheels 30 are freely rotatable on a centrally located shaft 32. Each flywheel 30 includes a crank pin 34 fixed thereto at a point spaced radially from the center thereof, i.e., eccentrically disposed. One end of a connecting link 26 is pivotally connected to the eccentric crank pin 34. Another end of the connecting link 26 is mechanically connected to the operating mechanism 5 in a manner which will be explained more fully later. Cooperating with the flywheel 30, is a heavy compression spring 40 having one end pivotally connected to the eccentric crank pin 34 and another end pivotally connected to a stationary pivot 42. The flywheel 30 has two different dead-center positions with respect to the spring 40. In the first one of these dead center positions, the axis of the crank pin 34 is located between the axis of shaft 32 and the axis of pivot pin 42 on a reference line 37 interconnecting the latter two axis. In the second one of these dead-center positions, the axis of crank pin 34 is located on the same reference line 37 but on the opposite side of the axis of shaft 32.

In FIG. 1, the parts are depicted in a position wherein the crank pin 34 has been driven in a counterclockwise or forward direction slightly past the first dead center position. Spring 40 is essentially fully charged and is biasing flywheel 30 in a counterclockwise direction but is blocked from discharging by a releasable stop means 45. When stop 45 is released, compression spring 40 is free to drive flywheel 30 in a counterclockwise direction from its position of FIG. 1. This counterclockwise motion of flywheel 30 is transmitted to connecting link 26 through eccentric crank pin 34 and acts to drive link 26 through a translation which effects a circuit breaker closing stroke. After the circuit breaker closing stroke, the flywheel 30 is in its second dead center position with the spring 40 substantially discharged (not shown). Flywheel driving means 60 and releasable coupling means 62 can then be utilized to forwardly rotate the flywheel 30 from the second dead center position back to, and slightly beyond, the first dead center position.

Figure 2:
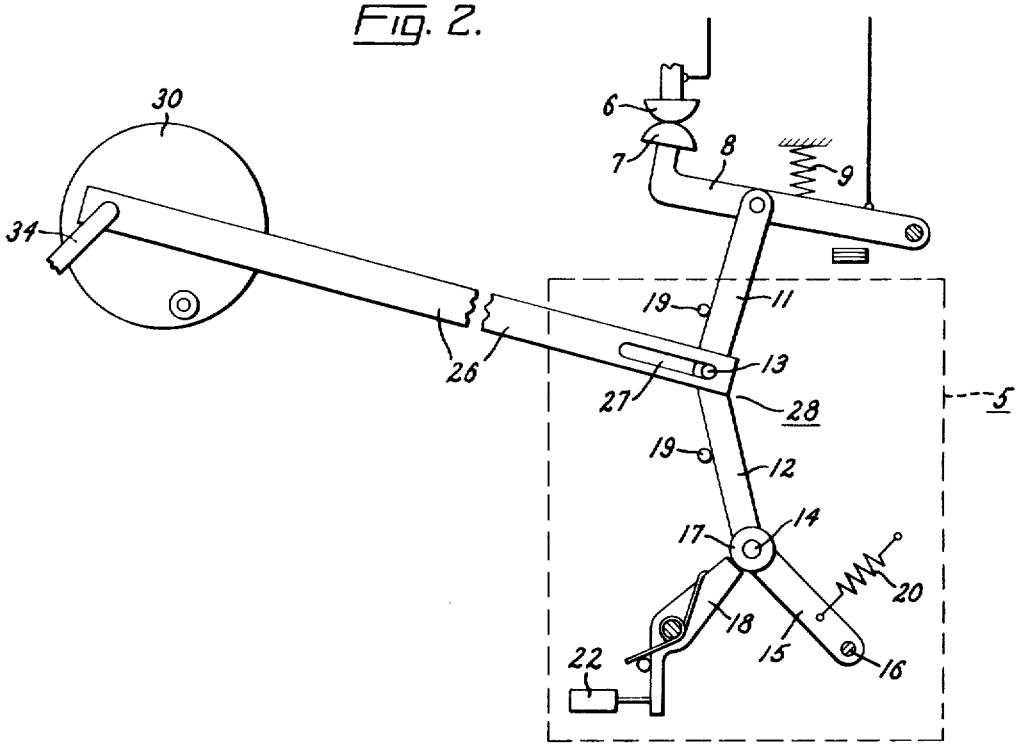
FIG. 2 is a schematic view showing the circuit breaker of FIG. 1 when the circuit breaker closing device has completed its closing operation and caused the circuit breaker to be in a closed position.

The circuit breaker operating mechanism 5 preferably comprises a mechanically trip-free operating mechanism. Such an operating mechanism is more fully described, and claimed, in my copending patent application of Ser. No. 703,328, filed July 8,1976, entitled "Stored-Energy Operating Means For An Electric Circuit Breaker". This application is hereby incorporated by reference in the present application. The operating mechanism 5 includes a pair of toggle links 11, 12 pivotally joined together by a knee 13. One of the toggle links 11 is pivotally connected at its opposite end to the movable contact arm 8 whereas the other of the toggle links 12 is connected by a pivot pin 14 to the left hand end of a guide link 15. Guide link 15 is pivotally supported at its right hand end on a fixed fulcrum 16. Pivot pin 14 carries a latch roller 17 which cooperates with a suitable trip latch 18. As long as trip latch 18 remains in its latched position shown, toggle 11, 12 is capable of transmitting closing thrust to the movable contact arm 8. Thus, when the knee 13 is driven to the left of the position of FIG. 1, toggle 11, 12 is extended toward an in-line position and thus drives the movable contact arm 8 upwardly toward the closed position of FIG. 2.

In one form of circuit breaker, of the present invention, the above-described circuit breaker closing force is transmitted to the toggle knee 13 through the connecting link 26. In a preferred circuit breaker system, a pin and slot coupling 28 is provided between the link 26 and the operating mechanism 5. This coupling comprises a slot 27 in the link 26 and an extension of knee 13 acting as the pin portion of the coupling and fitting slidably within the slot 27.

Referring again to FIG. 2, the connecting link 26 is shown moved to the left in accordance with the flywheel 30 being in its second dead-center position after the spring 40 has discharged. In this position, the circuit breaker is closed.

Figure 3:
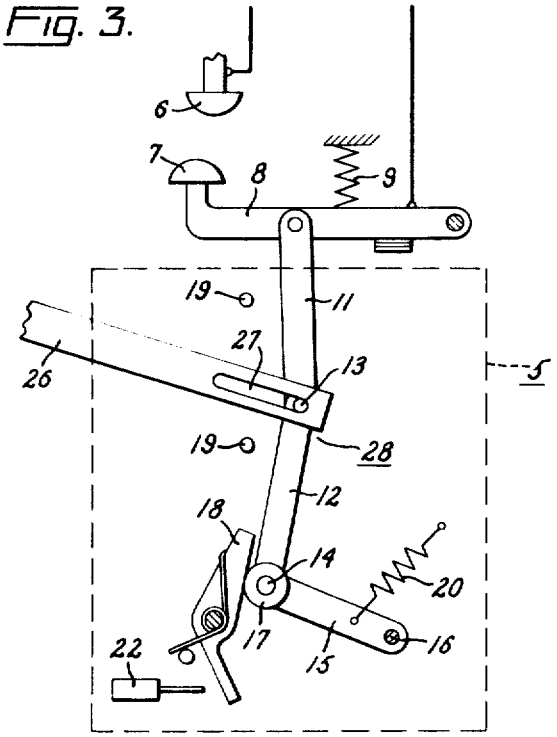
FIG. 3 is a schematic view showing the circuit breaker of FIGS. 1 and 2 after the circuit breaker trip latch has been released, thereby tripping the circuit breaker.

Referring now to FIG. 3, the operating mechanism is shown with the trip latch 18 released and breaker contacts 6, 7 separated. The trip latch 18 is released through suitable operation of the tripping solenoid 22. When the trip latch 18 is released, the operating mechanism 5 functions as a trip mechanism, tripping the circuit breaker contacts 6, 7 open. As previously discussed in the Background of the Invention, the tripping mechanism typically provides a co ntact parting time corresponding to a three cycle interrupting time rating, according to ANSI standards.

Figure 4A:
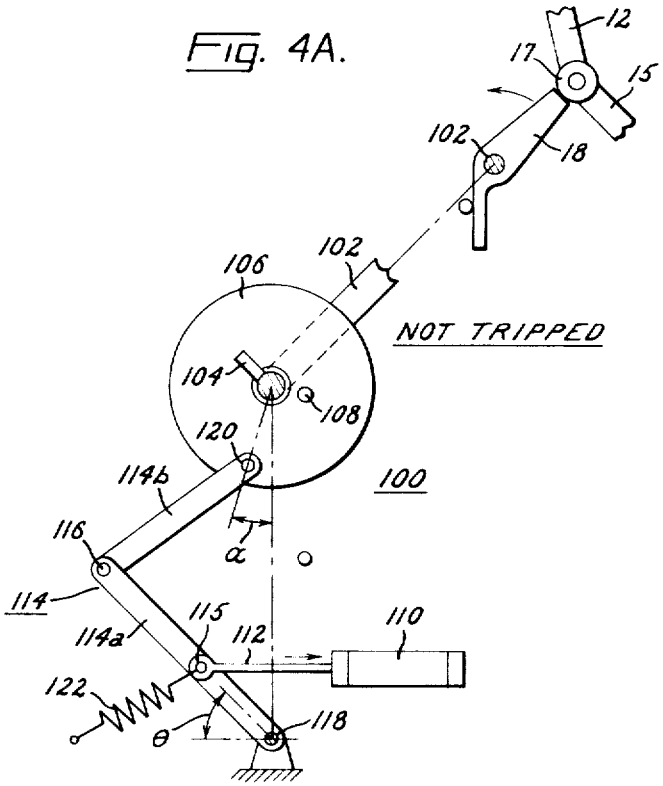
FIG. 4A, 4B, are schematic views showing one form of delayed tripping means of the present invention.

Referring now to FIG. 4A, one form of delayed tripping means of the present invention is generally designated 100. The tripping means 100 includes an axial trip shaft 102, to which is pinned or tightly coupled, a trip latch 18. The trip latch 18 of FIG. 4A may be similar to the trip latch 18 of the tripping mechanism shown in FIGS. 1-3. Tripping of the circuit breaker (not shown) is accomplished by causing the trip latch 18 to move in a counterclockwise direction shown by the arrow in FIG. 4A to the tripped position of FIG. 4B. In this form of the present invention, the trip shaft 102 is employed, in combination with other structure, to cause the trip latch 18 to move in the direction required for circuit breaker tripping.

The trip shaft 102 includes impact receiving means in the form of a radial extension 104. A tripping flywheel 106 is freely rotatable about the trip shaft 102. The tripping flywheel 106 includes impact imposing means in the form of an arm 108 extending axially outward from an eccentric point on a major face of the flywheel 106. As will be explained in more detail later, the impact imposing means 108 is adapted to cooperate with the impact receiving means 104 in order to cause the tripping shaft 102 to provide the necessary tripping motion to the trip latch 18.

The tripping flywheel 106 is coupled to an electric solenoid 110 through mechanical linkage coupling means 114. The electric solenoid 110 replaces the electric solenoid 22 of FIGS. 1-3. The coupling means 114 includes two links 114*a*, 114*b*, one end of each being pivotally joined at pivot 116. The other end of link 114*a* is pivotally connected to fixed pivot 118. The other end of link 114*b* is pivotally connected to tripping flywheel 106. More particularly, the other end of link 114*b* is pivotally connected to an eccentric crank pin 120 on the tripping flywheel 106. One end of the translatable armature 112 of solenoid 110 is pivotally connected to the link 114*a* through pivot 115. The other end of armature 112 is slidably contained in a cylindrical hole in the core of solenoid 110. A light restraining spring 122 is positioned to urge the link 114*a* to its normal, non-tripped position of FIG. 4A. It is from this non-tripped position (FIG. 4A) that trip action is initiated.

Figure 4B:
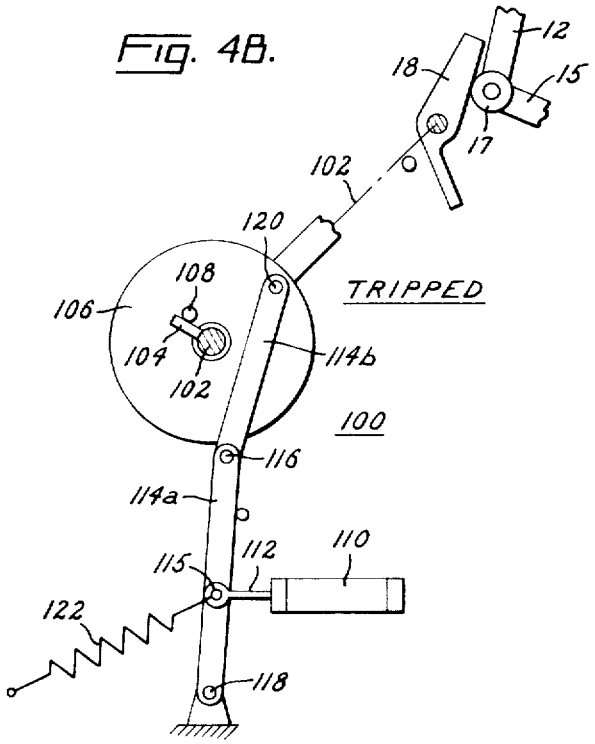

In the operation of the tripping means 100 of FIG. 4A, at the command pulse, the solenoid 110 is energized. This causes translation of the armature 112 in the direction shown by the arrow. This armature translation causes the relative positions of the components of the tripping means 100 to shift as shown in FIG. 4B. As the armature 12 translates, the tripping flywheel 106 is caused to rotate counterclockwise from a first position (FIG. 4A) not operating the trip latch 18 to a second position (FIG. 4B) operating the trip latch 18. More particularly, in the first position of FIG. 4A, the trip latch 18 is able to restrain the linkage of the operating mechanism 5 (FIGS. 1-3) so the contacts 6, 7 are maintained in a closed position. In the second position of FIG. 4B, the trip latch 18 is no longer able to restrain the linkage of the operating mechanism 5, causing the contacts 6, 7 to trip open under the action of spring biasing forces. In FIG. 4B, the impact imposing means 108 of the tripping flywheel 106 and the impact receiving means 104 of the trip shaft 102 are in an engaged relation wherein the trip shaft 102 is caused to rotate, thereby causing the necessary tripping motion of the trip latch 18. At the point of engagement, the circuit breaker is tripped substantially immediately.

Referring further to the operation of the delayed tripping means 100 of the present invention, at the beginning of the translation of the armature 112, the kinematics of the tripping means 100 is such that the majority of the kinetic energy is stored in the tripping flywheel 106 with relatively little kinetic energy being stored in the armature 112. In effect, this causes the tripping flywheel 106 to appear as an exceptionally large mass with respect to the force generated by the armature 112. This means that, the combination of the armature force and the inertia of the system, i.e., elements 112, 114*a*, 104*b*, 106, is sufficient to limit substantially the acceleration of the combined mass of the solenoid armature 112 and the tripping flywheel 106 coupled thereto. As a result, a significant time delay is developed as the solenoid armature 112 moves through the translation between its initial position of FIG. 4A to its final position of FIG. 4B. Note that, such a delay is effected even with a large force unbalance which may be provided by the solenoid armature 112 in order to minimize sensitivity, frictional, or spring variations which may be encountered.

Mathematically, referring again to FIG. 4A, at, or near the beginning of the translation of the armature 112, $d\alpha/d\theta >> 1$ where the relative velocity of the flywheel 106 with respect to the armature 112 is $d\alpha/d\theta$. Near the end of the translation of the armature 112, and particularly at the position shown in FIG. 4B corresponding to engagement of the impact imposing means 108 of the tripping flywheel 106 with the impact receiving means 104 of the trip shaft 102, the kinematic property of the coupling means 114 is such that the force generated at the armature 112 is mechanically amplified. This causes the impact imposing means 108 to forcibly engage the impact receiving means 104 and thereby facilitate forcing the trip latch 18 to the trip position. In general, mathematically, near the end of the armature translation, the kinematic properties are such that $d\alpha/d\theta << 1$. This can be appreciated in FIG. 4B, where coupling portions 114*a*, 114*b* are approaching (but not passing through) a toggle position when the trip latch 18 is tripped.

Figure 5:
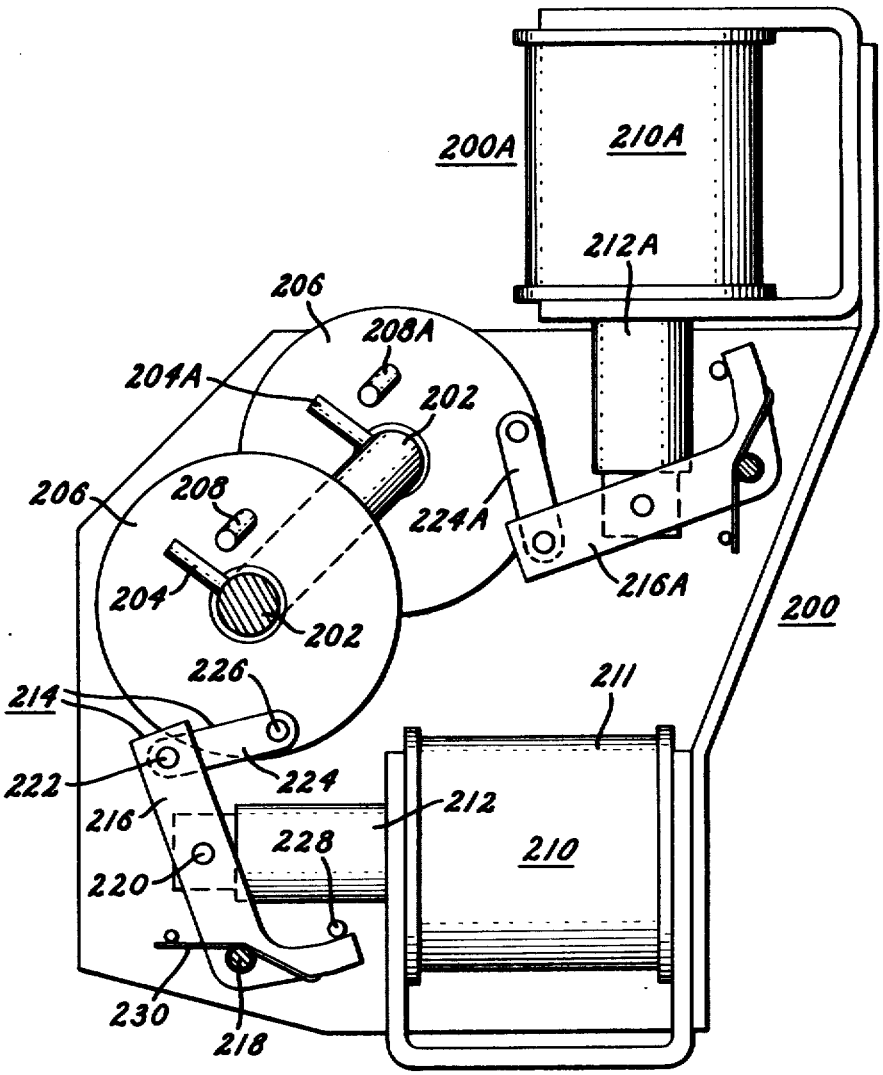
FIG. 5 is a schematic view showing another form of delayed tripping means of the present invention.

Referring now to FIG. 5, another form of delayed tripping means of the present invention is generally designated 200. The tripping means 200 includes an axial trip shaft 202 having impact receiving means 204 in the form of a radial extension joined firmly to shaft 202. A tripping flywheel 206 is axially constrained but freely rotatable about the trip shaft 202. The tripping flywheel 206 includes impact imposing means 208 in the form of a solid pin extending axially outward from an eccentric point on a major face thereof. As previously discussed in connection with the delayed tripping means 100 of FIGS. 4A, 4B, the impact imposing means 208 and impact receiving means 204 cooperate to effect operation of the circuit breaker trip latch (not shown in FIG. 5), thereby tripping the circuit breaker.

Solenoid 210 includes translatable armature 212. Translatable armature 212 is mechanically coupled to tripping flywheel 206 through linkage means 214 which includes drive link 216 and connecting link 224. The drive link 216 is coupled to fixed pivot 218 at one end and coupled at pivot 220 to armature 212. A further extension of drive link 216 includes a pivot point 222. The pivot point 222 of drive link 216 is pivotally connected to an end of the connecting link 224. Another end of connecting link 224 is pivotally connected at eccentric point 226 of tripping flywheel 206. Stop 228 is provided to provide a precise starting position for the coupled structure, i.e., links 216, 224, flywheel 206. Spring 230 provides light restraining force urging drive link 216 against stop 228 in its starting position.

The delayed tripping means 200 of FIG. 5 includes redundant tripping capability. The redundant tripping capability is provided by a second tripping assembly 200A which substantially duplicates the elements of the tripping means 200 which have been described above.

The second tripping assembly 200A is axially displaced along common axial trip shaft 202 and spatially oriented in a space-conserving manner with the axis of armature 212A being oriented differently with respect to a horizontal plane as compared to the axis of armature 212. The second tripping assembly 200A includes second flywheel means 206A with second impact imposing means 208A, and second impact receiving means 204A. Actuation of either solenoid 210 or 210A is effective to rotate common trip shaft 202, thereby tripping the circuit breaker. An advantage of the delayed tripping means 200 of FIG. 5 is that the redundant tripping capability offers improved reliability and also makes possible the operation of a given circuit breaker as either a three cycle breaker or a five cycle breaker. Also, if desired, a given circuit breaker may operate from two independent power sources, and at different voltages.

GENERAL CONSIDERATIONS

In order to obtain a five cycle interruption time rating, the following parameters have been found to be typical. Rotary inertia of tripping flywheel, 1.0 lb.-in$^2$; kinematic ratio of linkage coupling solenoid armature to flywheel ($d\alpha/d\theta$), $d\alpha/d\theta$ of 2 at beginning of armature translation, $d\alpha/d\theta$ of $\frac{1}{2}$ at latch trip position; solenoid coil, 10,000 ampere turns with a coil time constant of about 0.006 sec; armature cross section, $\sim 1$ in$^2$; armature translation, $\sim 1$ in; and flywheel angle of rotation, 2 radians.

It is to be appreciated that the five cycle delayed tripping hereinbefore discussed is simply adaptable to provide a three cycle interrupting time rating. More particularly, the coupling means 114 and flywheel 106 of the delayed tripping means 100 of FIGS. 4A, 4B can be removed and be replaced by a conventional non-delayed tripping structure(s). For example, one such non-delayed tripping structure may simply include a direct coupling of the solenoid armature to a single link which is rigidly connected to the trip shaft (not shown), or the structures of FIGS. 1–3.

Figure 6:
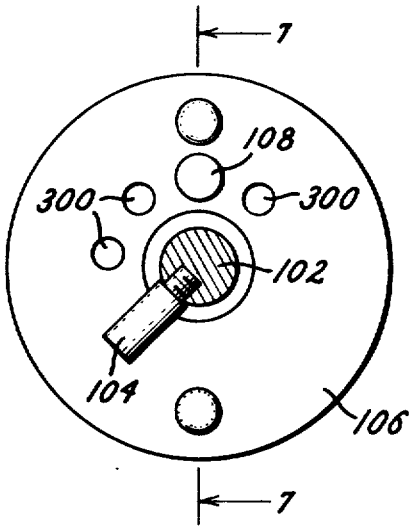
FIG. 6 is a partially sectioned side view of another form of flywheel-trip shaft configuration suitable for use in the present invention.
Figure 7:
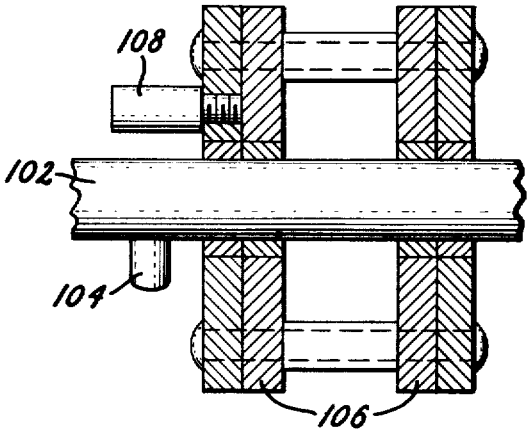
FIG. 7 is a partially sectioned edge view taken along line 7—7 of FIG. 6.
Figure 8:
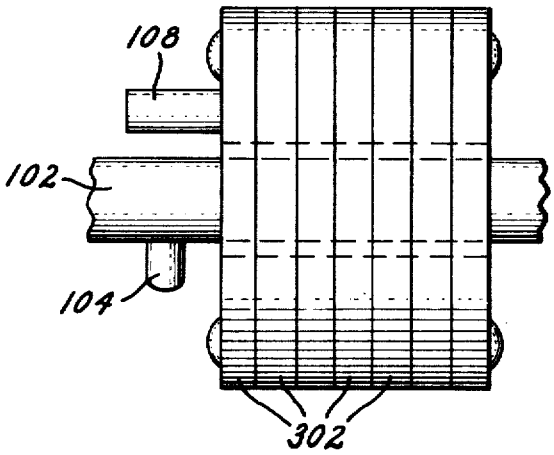
FIG. 8 is a partially sectioned edge view, taken as in FIG. 7, of still another form of flywheel-trip shaft configuration suitable for use in the present invention.

The delayed tripping means of the present invention allows one to selectably (and conveniently) provide various tripping delays. For example, as the mass of the tripping flywheel and the period of rotation thereof are major factors in providing the tripping delay, varying such mass and/or angle of rotation provides various tripping delays. Thus, as shown in FIGS. 6, 7, providing various locations 300 for impact imposing means 108 provide various angles between the first and second flywheel positions. Note that, for purposes of clarity, wherever possible, the reference numerals of FIGS. 4A, 4B have been employed. Further, a simple means to effect such increase/decrease tripping flywheel mass is shown in FIG. 8. The tripping flywheel structure of FIG. 8 comprises a plurality of bolt-on plates 302, each of the bolt-on plates 302 having a predetermined mass.

Although the delayed tripping means of the present invention has hereinbefore been described with a particular circuit breaker operating mechanism, i.e., a trip-free mechanism, other circuit breaker operating mechanisms may be employed. Further, although the delayed tripping means of the present invention has been described with a stored-energy operating device employing spring means for circuit breaker closing, other closing means may be employed, e.g., hydraulic closing means. Still further, it is to be appreciated that the delayed tripping means of the present invention is not limited to tripping vacuum circuit breakers but is broadly applicable to a circuit breaker system in which a mechanical operation of an element is desired to follow the initiation of a command pulse after a pedetermined delay.

While I have show and described particular embodiments of my invention, it will be obvious to those skilled in the art that various changes and modifications may be made without departing from my invention in its broader aspects, and I, therefore, intend herein to cover all such changes and modifications as fall within the true spirit and scope of my invention.

What I claim as new and desire to secure by Letters Patent of the United States is:

1. In combination with an electric circuit breaker, means for providing a predetermined delay between the initiation of a command pulse and the mechanical operation of an element of the circuit breaker in response to the command pulse, which comprises:

(a) axial shaft means mechanically coupled to said element of said circuit breaker which is to be operated wherein a preselected rotation of said shaft means causes said mechanical operation of said element, said axial shaft means including impact receiving means extending radially from said shaft means;

(b) flywheel means rotatable about said axial shaft means, said flywheel means including impact imposing means extending generally axially outward from a major face of said flywheel means;

(c) an electric solenoid having a translatable armature for rotating said flywheel means, said electric solenoid receiving said command pulse; and (d) coupling means mechanically coupling said translatable armature to an eccentrically located point on said flywheel means wherein translation of said armature causes said flywheel means to rotate through said predetermined delay from a first position not operating said element of said circuit breaker to a second position operating said element wherein at said second position said impact imposing means of said flywheel means engages said impact receiving means of said shaft means and causes said preselected rotation of said shaft means and said operating of said element.

2. Means for providing said predetermined delay in accordance with claim 1 in which:

(a) at the beginning of said translation of said armature with said flywheel means at said first position, the kinetic energy distribution is such that most of the kinetic energy is in said flywheel means with relatively little kinetic energy being in said translatable armature wherein said flywheel means appears as a relatively large mass with respect to said armature which causes said predetermined time delay in rotation of said flywheel means from said first position to said second position; and (b) near the end of said translation of said armature with said flywheel means at said second position, said coupling means mechanically amplifies the rotating force applied to said flywheel means by said translatable armature causing said impact imposing means of said flywheel means to forcefully engage said impact receiving means of said shaft means.

3. Means for providing said predetermined delay in accordance with claim 2 wherein said delay is adjustable and in which said flywheel means includes a plurality of flywheel plates removably secured together.

4. Means for providing said predetermined delay in accordance with claim 2 wherein said delay is adjustable and in which the angle between said first position and said second position of said flywheel means is adjustable.

5. Means for providing said predetermined delay in accordance with claim 2 in which said element comprises a trip mechanism of said circuit breaker and in which said preselected rotation of said shaft means causes said operating of said trip mechanism.

6. Means for providing said predetermined delay in accordance with claim 2 in which said circuit breaker comprises a vacuum circuit breaker.

7. A vacuum circuit breaker with circuit breaker closing means and circuit breaker tripping means, the circuit breaker tripping means including delayed tripping means, which comprises:

(a) circuit breaker tripping mechanism coupled to said circuit breaker for tripping said circuit breaker;

(b) axial trip shaft means mechanically coupled to said tripping mechanism wherein a preselected rotation of said trip shaft means operates said tripping mechanism, said trip shaft means including impact receiving means extending radially therefrom;

(c) tripping flywheel means rotatable about said axial trip shaft means, said tripping flywheel means including impact imposing means extending generally axially outward from a major face of said flywheel means;

(d) an electric solenoid having a translatable armature for rotating said tripping flywheel means; and (e) coupling means mechanically coupling said translatable armature to an eccentrically located point on a major face of said flywheel means wherein translation of said armature causes said flywheel means to rotate through said predetermined delay from a first position not operating said tripping mechanism to a second position operating said tripping mechanism wherein at said second position said impact imposing means of said tripping flywheel means engages said impact receiving means of said trip shaft means and causes said preselected rotation of said trip shaft means and said operating of said trip mechanism.

8. A vacuum circuit breaker in accordance with claim 7 in which (a) at the beginning of said translation of said armature with said flywheel means at said first position, the kinetic energy distribution is such that most of the kinetic energy is in said tripping flywheel means with relatively little kinetic energy being in said translatable armature wherein said flywheel means appears as a relatively large mass with respect to said armature which causes said predetermined delay in rotation of said flywheel means from said first position to said second position; and (b) near the end of said translation of said armature with said flywheel means at said second position, said coupling means mechanically amplifies the rotating force applied to said flywheel means by said translatable armature causing said impact imposing means of said flywheel means to forcefully engage said impact receiving means of said shaft means.

9. A vacuum circuit breaker in accordance with claim 8 in which said predetermined delay is adjustable and in which the angle between said first position and said second position of said tripping flywheel means is adjustable.

10. A vacuum circuit breaker in accordance with claim 8 in which said predetermined delay is adjustable and in which said flywheel means includes a plurality of flywheel plates removably secured together.

11. A vacuum circuit breaker in accordance with claim 8 in which said circuit breaker tripping mechanism includes a trip latch coupled to said axial trip shaft means wherein said preselected rotation of said trip shaft means causes said trip latch to rotate and cause substantially immediate tripping of said circuit breaker.

12. A vacuum circuit breaker in accordance with claim 11 in which redundant delayed tripping means is provided, the redundant tripping means including a second impact receiving means extending radially from said axial trip shaft means and axially spaced from said impact receiving means, a second tripping flywheel means including second impact imposing means extending generally outward from a major face of said second tripping flywheel means, said second tripping flywheel means being axially spaced from said tripping flywheel means with said second impact imposing means being axially aligned with said second impact receiving means, a second electric solenoid having a translatable armature for rotating said second tripping flywheel means, and second coupling means mechanically coupling said translatable armature of said second solenoid to an eccentrically located point on a major face of said second flywheel means wherein translation of said armature causes said second flywheel means to rotate through a predetermined delay from a first position not operating said tripping mechanism to a second position operating said tripping mechanism wherein at said second position said second impact imposing means of said second tripping flywheel means engages said second impact receiving means of said trip shaft means and causes said preselected rotation of said trip shaft means and said operating of said trip mechanism.

13. A vacuum circuit breaker in accordance with claim 12 in which said translatable armatures of said solenoid and second solenoid are oriented differently with respect to a horizontal plane.

14. A vacuum circuit breaker in accordance with claim 11 in which said circuit breaker closing means includes a stored-energy operating device.

15. In combination with an electric circuit breaker, means for providing a predetermined delay between the initiation of a command pulse and the mechanical operation of an element of the circuit breaker in response to the command pulse, which comprises:

(a) axial shaft means mechanically coupled to said element of said circuit breaker which is to be operated wherein a preselected rotation of said shaft means causes said mechanical operation of said element, said axial shaft means including impact receiving means extending radially from said shaft means;

(b) flywheel means rotatable about said axial shaft means, said flywheel means including impact imposing means eccentrically disposed on said flywheel means;

(c) an electric solenoid having a translatable armature for rotating said flywheel means, said electric solenoid receiving said command pulse; and (d) coupling means mechanically coupling said translatable armature to an eccentrically located point on said flywheel means wherein translation of said armature causes said flywheel means to rotate through said predetermined delay from a first position not operating said element of said circuit breaker to a second position operating said element wherein at said second position said impact imposing means of said flywheel means engages said impact receiving means of said shaft means and causes said preselected rotation of said shaft means and said operating of said element.

16. Means for providing said predetermined delay in accordance with claim 15 in which:

(a) at the beginning of said translation of said armature with said flywheel means at said first position, the kinetic energy distribution is such that most of the kinetic energy is in said flywheel means with relatively little kinetic energy being in said translatable armature wherein said flywheel means appears as a relatively large mass with respect to said armature which causes said predetermined time delay in rotation of said flywheel means from said first position to said second position; and (b) near the end of said translation of said armature with said flywheel means at said second position, said coupling means mechanically amplifies the rotating force applied to said flywheel means by said translatable armature causing said impact imposing means of said flywheel means to forcefully engage said impact receiving means of said shaft means.

17. Means for providing said predetermined delay in accordance with claim 16 wherein said delay is adjustable and in which said flywheel means includes a plurality of flywheel plates removably secured together.

18. Means for providing said predetermined delay in accordance with claim 16 wherein said delay is adjustable and in which the angle between said first position and said second position of said flywheel means is adjustable.

19. Means for providing said predetermined delay in accordance with claim 16 in which said element comprises a trip mechanism of said circuit breaker and in which said preselected rotation of said shaft means causes said operating of said trip mechanism.

20. Means for providing said predetermined delay in accordance with claim 16 in which said circuit breaker comprises a vacuum circuit breaker.

21. Means for providing said predetermined delay in accordance with claims 1, 7, or 15 in which at the beginning of said translation of said armature with said flywheel means at said first position, the kinetic energy distribution is such that most of the kinetic energy is in said flywheel means with relatively little kinetic energy being in said translatable armature wherein said flywheel means appears as a relatively large mass with respect to said armature which causes said predetermined time delay in rotation of said flywheel means from said first position to said second position.

* * * * *